US005893785A

United States Patent [19]

Baldwin, III

[11] Patent Number: 5,893,785

[45] Date of Patent: Apr. 13, 1999

[54] POZI FLEX

[76] Inventor: Cedric Baldwin, III, 1035 Kaimoku Pl., Honolulu, Hi. 96821

[21] Appl. No.: 08/925,179

[22] Filed: Sep. 9, 1997

Related U.S. Application Data

[XX .

[60] Provisional application No. 60/025,652, Sep. 9, 1996.

[51] Int. Cl.[6] ..... B63B 1/00

[52] U.S. Cl. ..... 441/75

[58] Field of Search ..... 441/65, 74, 75, 441/79; 280/611; 114/39.2

[56] References Cited

U.S. PATENT DOCUMENTS

| | | | |
|---|---|---|---|
| 4,693,199 | 9/1987 | Omachen et al. . | |
| 4,846,744 | 7/1989 | Love . | |
| 4,960,063 | 10/1990 | Bontemps . | |
| 5,018,468 | 5/1991 | Peterson | 441/75 |
| 5,045,006 | 9/1991 | Sperzel et al. . | |
| 5,125,859 | 6/1992 | Spurgeon . | |
| 5,167,553 | 12/1992 | Wilson . | |
| 5,378,181 | 1/1995 | Sewell . | |
| 5,484,312 | 1/1996 | Zepeda . | |
| 5,558,552 | 9/1996 | Namur | 441/75 |

*Primary Examiner*—Stephen Avila
*Attorney, Agent, or Firm*—James Creighton Wray; Meera P. Narasimhan

[57] ABSTRACT

An adjustable footstrap for sailboards which includes a combination of end pieces made from a mold and constructed of a flexible rubber material. The flexible rubber material gives the footstrap a firm arch curve from end to end. The flexible rubber material also allows the footstrap to retain its shape for a long period of time. The end pieces are connected by a strap. The strap is secured in its desired position by positioning Velcro along the surfaces of the mating sections. For providing user comfort, a cover is positioned over surfaces of the footstrap that come into contact with a user's foot.

46 Claims, 3 Drawing Sheets

POZI FLEX

This application claims the benefit of U.S. Provisional Application Ser. No. 60/025,652, filed Sep. 9, 1996, now abandoned.

BACKGROUND OF THE INVENTION

The present invention relates to footstraps of sailboards into which sailors' feet are positioned for stabilizing the sailors on the boards.

Existing sailboards for windsurfers include footstraps that enable users to negotiate rough waters and perform acrobatic maneuvers without slipping off the boards and into the water. Conventional footstraps, over a short period of time, become mushy and limp due to water absorption. Existing footstraps become more difficult to use over time as normal sailing abuse deforms the straps and cause the straps to lose their foot-receiving shapes. Needs exist for footstraps that are long lasting and that are not rendered ineffective by water and normal sailing conditions.

SUMMARY OF THE INVENTION

The present invention is a footstrap for sailboards. The footstrap includes a combination of end pieces which are made from a mold and are constructed of a flexible rubber material. The end pieces are in the shape of the letter L and are about 2 inches wide and 5 and ¾ inches tall. The end pieces stand apart, with the back of one end piece facing the back of the other end piece and with the bottom corner of the letter being the base. A one inch wide strapping is connected to the base of one end piece at a first end by a pin, is pulled over the top of the end pieces to create an arc, transverses around a pin on the opposing end piece base and is finally overlapped onto itself and secured by use of Velcro. The cover is made of a 5 mm neoprene pattern into the top side of which is sewn a zipper. The ends of the cover have semicircle shaped neoprene and slotted vinyl base booties into which the bottom member of the molded pieces fit. That cover arrangement combined with the strap connected end pieces creates a comfortable, firm constant curve arc anti-mush footstrap which allows for height and width adjustment.

The new footstrap end pieces are made of a mold-formed flexible rubber, which when applied, allows the footstrap to have a firm arch curve from end to end, which allows a sailor to insert a foot easily. The present invention also resists mushing when stepped on. The flex of the rubber end pieces causes the footstrap to open or pop back to its original curvature. The invention also allows for width adjustment for large and small feet.

These and further and other objects and features of the invention are apparent in the disclosure, which includes the above and ongoing written specification, with the claims and the drawings.

DETAILED DESCRIPTION OF THE PREFERRED EMBODIMENTS

Figure 1:
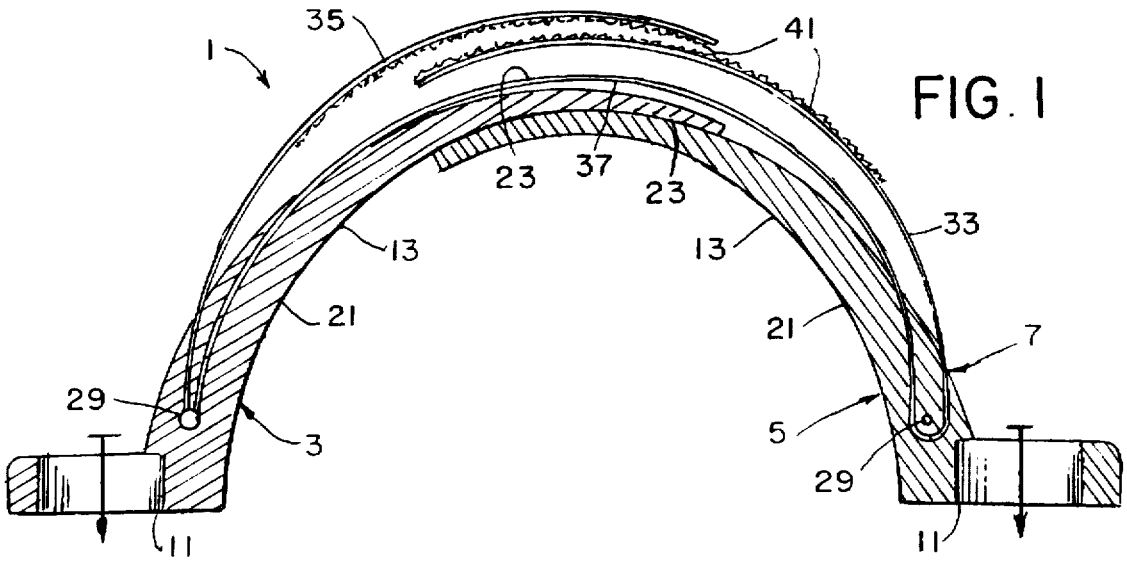
FIG. 1 shows the present footstrap including a pair of end pieces connected by a strap.
Figure 2:
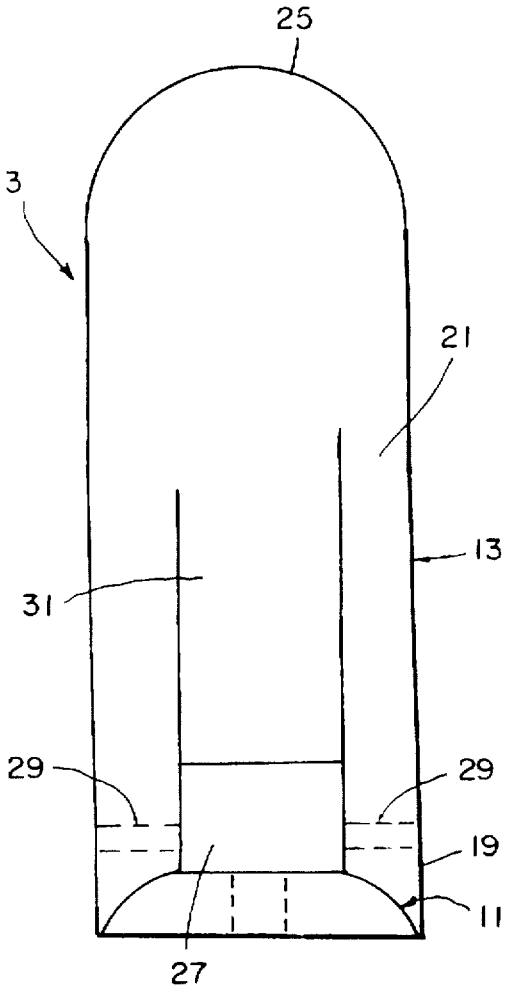
FIG. 2 is a front view of an end piece of the present invention.
Figure 3:
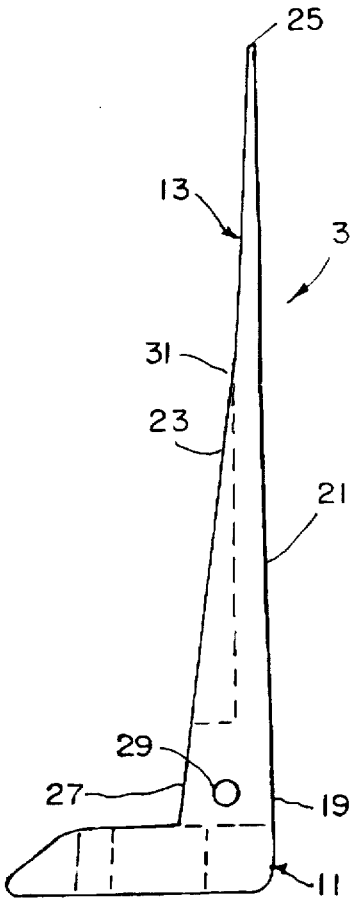
FIG. 3 is a side view of the end piece shown in FIG. 2.
Figure 4:
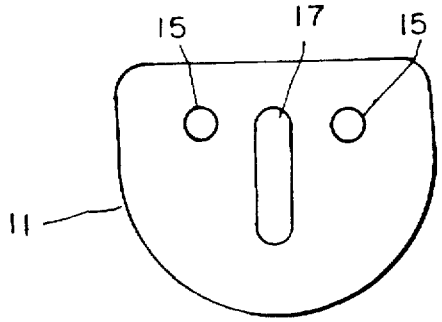
FIG. 4 is a bottom view of the end piece shown in FIG. 2.
Figure 7:
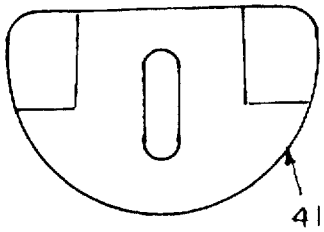
FIG. 7 is a top view of the end piece shown in FIG. 6.
Figure 5:
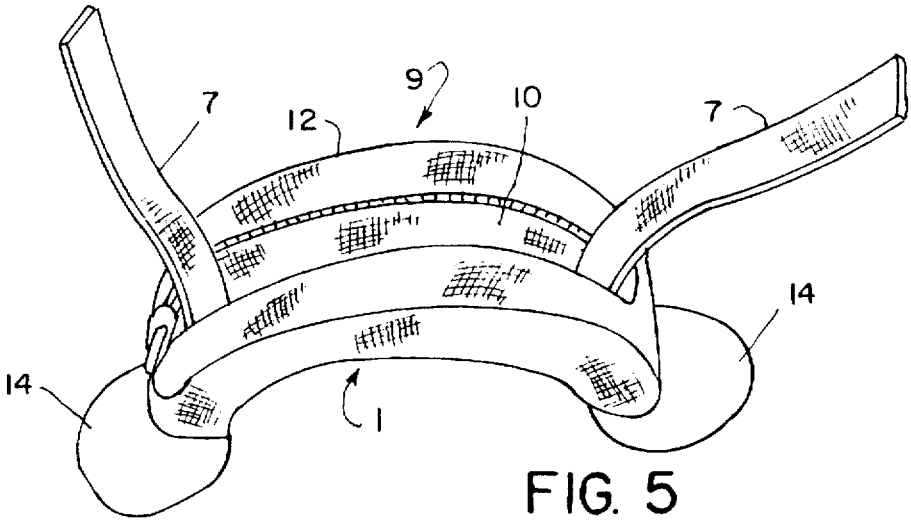
FIG. 5 shows the present invention having a cover positioned over the end pieces such that the strap is adjustable without removing the cover.
Figure 6:
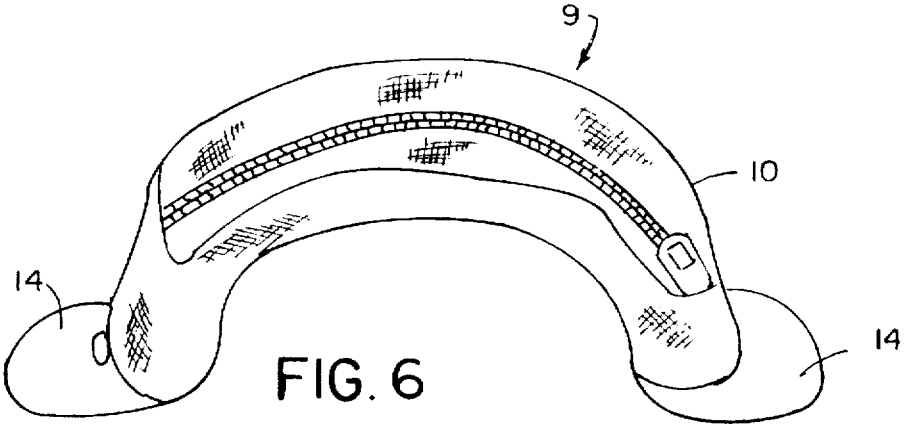
FIG. 6 shows the present invention having a cover enclosing the end pieces and the entire strap.
Figure 8:
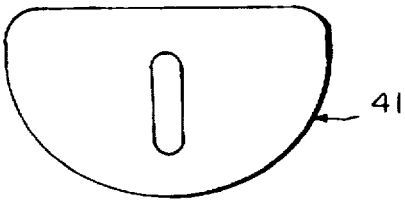
FIG. 8 is bottom view of the end piece shown in FIG. 6.
Figure 9:
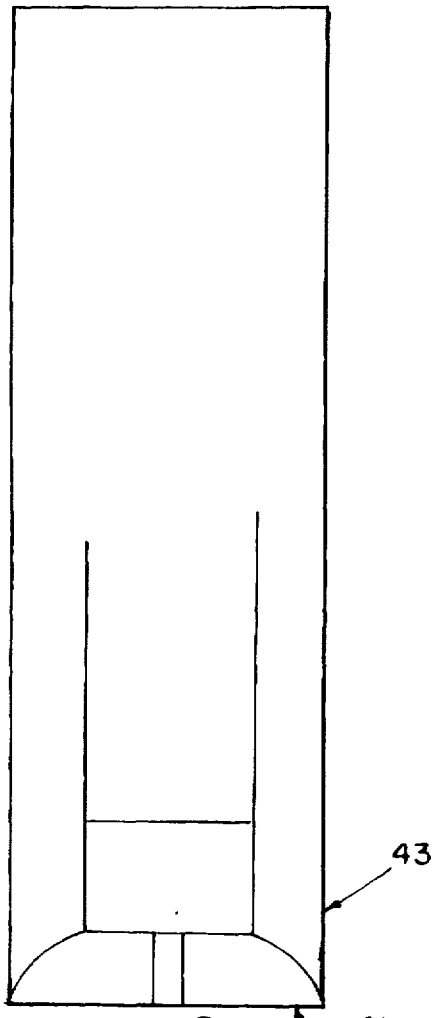
FIG. 9 is a front view of an end piece of an alternative embodiment.

As shown in the FIG. 1, the present invention is a footstrap 1 for sailboards. The footstrap 1 includes a pair of end pieces 3, 5 connected by a strap 7. As shown in FIG. 5, a cover 9 is positioned over the end pieces 3, 5 such that the strap 7 may be adjusted without removing the cover 9.

As shown in FIGS. 1–4, each base 3 or 5 has a bottom member 11 and an upstanding member 13 extending from the bottom member 11. The bottom member 11 rests on the upper surface of the sailboard and is connected to the sailboard by stainless steel bolts or screws or other appropriate connecting means. Holes 15 and slots 17 extend through the bottom member 11 for receiving the bolts, screws or other connecting means.

Preferably, the base 3 or 5 is a one-piece molded structure made of a deformable, resilient material, such as flexible rubber. In one preferred embodiment, each base 3 or 5 is generally L-shaped, has a bottom member 11 with a width of about 2 inches, a length of about 1 and ⅝ inches and a thickness of about ⅛ inch, and has an upstanding member 13 with a width of about 2 inches, a thickness that gradually decreases from 7/16 inch to ⅛ inch, and a height of about 5 and ¾ inches.

The upstanding member 13 of each base 3 or 5 has a lower end 19 connected to an end of the bottom member 11, a generally vertical inner surface 21 and an outer surface 23 that extends upward and inward from the bottom member 11, such that the thickness of the upstanding member 13 gradually decreases from its lower end 19 to its upper end 25. An opening 27 extends through a lower part of the upstanding member 13. A pin 29 extends from sides of the upstanding member 13 and through the opening 27. A sloping recess 31 is positioned in the outer surface 23 of the upstanding member 13 directly above the opening 27.

As shown in FIG. 1, a pair of bases 3, 5 are mounted on the sailboard such that the inner surfaces 21 of the upstanding members 13 are facing each other. The bases 3, 5 are connected by a strap 7. The strap 7 is made of any acceptable material The strap 7 includes a pair of free, mating sections 33, 35 separated by a non-mating section 37. The strap 7 is looped around or connected to the pins 29 of the opposing bases such that the non-mating section 37 proceeds along the outer surface 23 of the upstanding member 13 of the first base 3 and continues along the outer surface 23 of the upstanding member 13 of the second base 5. One mating section 33 overlaps the non-mating section 37, and the other mating section 35 overlaps the first mating section 33. Velcro or other acceptable mating means 41 are positioned along the surfaces of the mating sections 33, 35 for securing the strap 7 in its desired position, thereby urging the upstanding members 13 inward and downward and forming an arc.

The upper end 25 of one upstanding member 13 overlaps the upper end of the other upstanding member.

As shown in FIG. 5, for user comfort, a cover 9 is positioned over the whole surface of the footstrap which may come into contact with a user's foot. Preferably, the cover 9 is made of a neoprene material pattern having a long, plastic zipper 10 along the upper surface 12 of the cover. Ends 14 of the cover 9 have semicircle shaped neoprene and slotted vinyl base booties in which bottom members 11 of the bases 3, 5 fit. Preferably, the cover 9 is a one-piece structure. The cover 9 wraps around and encloses the upstanding members 13 and the bottom members 11 of the bases 3, 5 and the entire strap 7. The mating sections 33, 35 overlap and connect to each other inside the cover 9. That allows for height adjustment of the footstrap 1 by opening the zipper 10, without necessitating removal of the cover 9.

FIGS. 7–10 show an alternative embodiment of the footstrap. The bottom member 41 may have a shorter length than the bottom member 11 of FIG. 2. The upstanding member 43 may have a greater height than the upstanding member 13 of FIG. 2.

Figure 12:
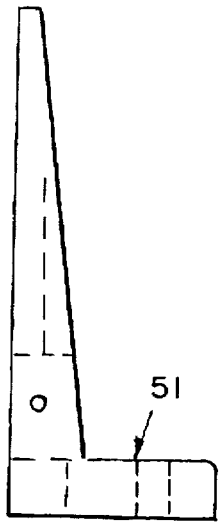
FIG. 12 is a side view of the end piece shown in FIG. 10.
Figure 10:
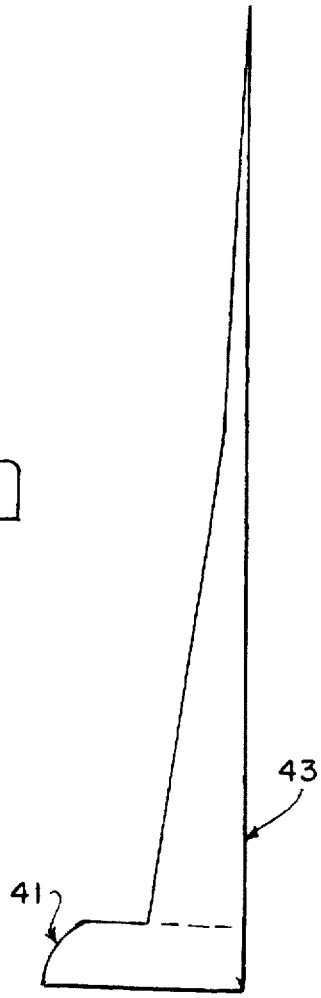
FIG. 10 is a side view of the end piece shown in FIG. 6.
Figure 11:
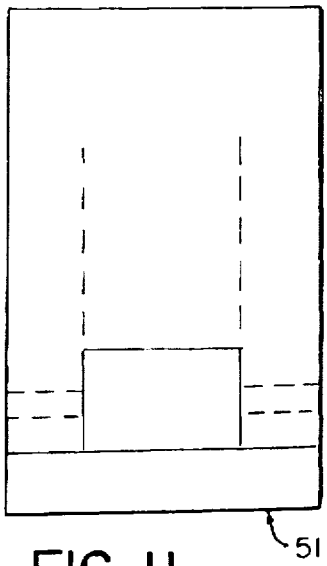
FIG. 11 is a front view of an end piece of an alternative embodiment.
Figure 13:
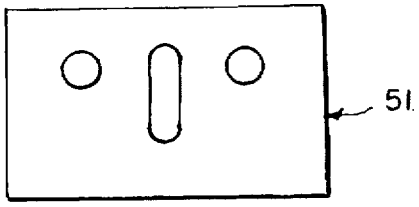
FIG. 13 is a bottom view of the end piece shown in FIG. 10.

FIGS. 11–13 show an alternative embodiment of the footstrap. The bottom member 51 may have a lesser thickness than the bottom member 11 of FIG. 2.

The present footstrap 1 provides a firm arch curve from end to end which allows for easy and quick foot insertion. Mushing and other wear-and-tear abuse are avoided as the resilient bases 3, 5 ensure that the footstrap 1 always returns to its original curvature. By including a slot 17 in the bottom member 11 of the bases 3, 5, width adjustment is easily accomplished.

While the invention has been described with reference to specific embodiments, modifications and variations of the invention may be constructed without departing from the scope of the invention, which is defined in the following claims.

I claim:

1. A sailboard footstrap comprising first and second overlapping end pieces, a strap for connecting the end pieces and a cover for positioning over the strap for providing user comfort.

2. The apparatus of claim 1, wherein the first and second end pieces are made of a flexible rubber material.

3. The apparatus of claim 1, wherein the first and second end pieces have a bottom member and an upstanding member, the upstanding member having a generally vertical inner surface and an outer surface that extends upward and inward from the bottom member.

4. The apparatus of claim 1 wherein the bottom member has holes and a slot for receiving connecting means for securing the footstrap to the sailboard.

5. The apparatus of claim 3, wherein the upstanding member further comprises an opening, a pin extending from sides of the upstanding member through the opening and a sloping recess directly above the opening.

6. The apparatus of claim 4, wherein the strap further comprises first and second mating sections separated by a non-mating section.

7. The apparatus of claim 5, wherein the strap is looped around the pins of the end pieces, the non-mating section of the strap proceeds along the outer surface of the upstanding member of the first end piece and continues along the outer surface of the second end piece, the first mating section overlapping the non-mating section, the second mating section overlapping the first mating section.

8. The apparatus of claim 4 wherein the bottom member may be moved along the sailboard by securing the connecting means at another location within the slot for width adjustment of the footstrap.

9. The apparatus of claim 1 wherein the cover has an upper surface and ends for enclosing the upstanding members and the bottom members of the end pieces and the entire strap.

10. The apparatus of claim 9 wherein the ends of the cover further comprise semicircle shaped neoprene and slotted vinyl base booties into which the bottom members and upstanding members of the end pieces fit.

11. The apparatus of claim 9 wherein the upper surface of the cover further comprises a zipper for adjusting the height of the footstrap without removing the cover.

12. Sailboard footstraps comprising at least two overlapping end pieces, each end piece having first and second portions, the first portion being removably connected to the sailboards, the second portion having a free standing member, and a strap for removably connecting the at least two end pieces along free ends of the second portions.

13. The footstraps of claim 12, further comprising a cover enclosing the at least two end pieces and the strap.

14. The footstraps of claim 13, wherein the cover, the end pieces and the strap are made of a flexible polymer.

15. The footstraps of claim 12, wherein the end pieces are made of a flexible rubber material.

16. The footstraps of claim 12, wherein each end-piece is a one-piece molded structure of a deformable, resilient material.

17. The footstraps of claim 12, wherein the free standing member extends upward and inward from the first portion.

18. The footstraps of claim 12, wherein the at least two end pieces are spaced apart with a rear side of one end piece facing a rear side the other end piece.

19. The footstraps of claim 12, wherein each end piece is L-shaped.

20. The footstraps of claim 19, wherein a lower end of the L-shaped end piece forms the first portion.

21. The footstraps of claim 13, wherein the cover is a wide strapping having first and second ends, the first end connected one end piece at, the second end connected to the other end piece, the cover enclosing tops of the at least two end pieces forming an arc.

22. The footstraps of claim 21, further comprising connectors on the end pieces and complementary receivers on the cover for connecting the cover to the end pieces, wherein the connectors and receivers are interchangeable.

23. The footstraps of claim 21, further comprising Velcro on the cover for overlapping sides of the cover itself and securing the end pieces within the cover.

24. The footstraps of claim 13, wherein the cover is of neoprene material.

25. The footstraps of claim 21, wherein further comprising a zipper on the cover for connecting sides of the cover and enclosing the end pieces within the cover.

26. The footstraps of claim 21, wherein the ends of the cover are semicircle shaped with slotted base booties for receiving the first portions of the end pieces.

27. The footstraps of claim 21, wherein the cover enclosing the end pieces forms a firm constant curve anti-mush arc.

28. The footstraps of claim 22, wherein the connectors are pins and the receivers are slots.

29. The footstraps of claim 12, further comprising openings and slots in the first portions for receiving the connectors from the cover and from the sailboards.

30. The footstraps of claim 12, wherein each free standing member has a thickness gradually decreasing from respective first portions towards the free ends.

31. The footstraps of claim 12, wherein each free standing member has a lower end connected to an end of the first portion, a generally vertical inner surface and an outer surface extending upward and inward from the first portion, wherein a thickness of the free standing member gradually decreases from a lower end to the free ends.

32. The footstraps of claim 12, further comprising an opening in a lower part of the free standing member.

33. The footstraps of claim 32, further comprising a pin extending from sides of the free standing member through the opening.

34. The footstraps of claim 32, further comprising a sloping recess on an outer surface of the free standing member above the opening.

35. The footstraps of claim 12, wherein the strap comprises a pair of free, mating sections separated by a non-mating section.

36. The footstraps of claim 35, wherein the strap is a loop around the end pieces, wherein the non-mating section abuts outer surfaces of the first and second portions.

37. The footstraps of claim 35, wherein one mating section overlaps the non-mating section and the other mating section overlaps the first mating section.

38. The footstraps of claim 35, further comprising mating means for connecting the straps at desired positions on the free standing members and for urging the free standing members downwards to form an adjustable arc.

39. The footstraps of claim 38, wherein a free end one free standing member overlaps a free end of another free standing member.

40. The footstraps of claim 38, wherein the cover removably encloses the first portions, the free standing members and the mating and non-mating sections of the strap.

41. The footstraps of claim 40, wherein the mating sections overlap and connect to each other inside the cover allowing for height adjustment of the footstrap without removal of the cover.

42. The footstraps of claim 12, wherein lengths of the first is shorter than lengths of the second portions.

43. The footstraps of claim 12, further comprising openings and slots on the first portions and connectors on the sailboards for securing the footstraps to the sailboards.

44. The footstraps of claim 12, wherein the strap further comprises first and second mating sections separated by a non-mating section.

45. The footstraps of claim 43, wherein the bottom member is adjustably positioned on the sailboard along the slots allowing for width adjustment of the footstraps.

46. The footstraps of claim 12, wherein the cover has an upper surface and ends for enclosing the end pieces and the strap.

* * * * *